United States Patent [19]

Taylor et al.

[11] Patent Number: 4,612,753

[45] Date of Patent: Sep. 23, 1986

[54] METHOD AND APPARATUS FOR LOCKING A CARRIER

[75] Inventors: Bobby C. Taylor, Eros; Peter C. Olsen, Jr., West Monroe, both of La.

[73] Assignee: Manville Service Corporation, Denver, Colo.

[21] Appl. No.: 741,983

[22] Filed: Jun. 6, 1985

[51] Int. Cl.[4] ..... B65B 21/24

[52] U.S. Cl. ..... 53/398; 53/48; 493/139; 493/390

[58] Field of Search ..... 53/398, 48, 462; 493/390, 137, 139, 426, 427

[56] References Cited

U.S. PATENT DOCUMENTS

| | | | |
|---|---|---|---|
| 3,254,470 | 6/1966 | Currie, Jr. | 53/48 |
| 3,332,199 | 7/1967 | Wong | 53/48 X |
| 3,387,428 | 6/1968 | Currie, Jr. | 53/48 X |
| 4,062,270 | 12/1977 | Culpepper | 493/137 |

*Primary Examiner*—James F. Coan

*Attorney, Agent, or Firm*—John D. Lister; Cornelius P. Quinn; Timothy R. Schulte

[57] ABSTRACT

A method and apparatus for closing a carrier about a one or more articles. The invention includes one or more fingers which are urged into contact with locking tabs on the carrier to force the locking tabs through an opening on the carrier. The fingers may be activated by a rotating cam operated device or may be electromagnetically activated.

9 Claims, 11 Drawing Figures

METHOD AND APPARATUS FOR LOCKING A CARRIER

BACKGROUND OF THE INVENTION

1. Field of the Invention

The invention relates to the field of carrier lock closing apparatus. More particularly, the invention relates to an apparatus for closing a carrier which has been wrapped around one or more articles by forcing a larger tab through a smaller opening. In still greater particularity, the invention relates to a finger mechanism which is urged into contact with the tab thereby forcing the tab through the opening. By way of further characterization, but not by way of limitation thereto, the invention relates to a finger which may be cam operated or electromagnetically directed into said tab.

2. Description of the Prior Art

Carriers for transporting beverage containers such as those containing beer or soda have long been utilized in the beverage industry. Generally, these carriers are of a paperboard construction. Paperboard allows the carrier to be flexible yet strong enough to support relatively heavy loads. In addition, paperboard allows the packager to include advertising on the outside of the carrier. The use of paperboard carriers requires that the carrier be secured around the article or articles. Various locking mechanisms have been employed to secure the carriers around the articles. One such locking device is shown in U.S. Pat. No. 4,437,606 issued to Manville Service Corporation, the Assignee of the present invention. This patent is made a part of the specification hereof and incorporated herein by reference. Generally, this locking mechanism includes a tab and an opening. The tab is larger than the opening and is forced through the opening thereby locking the carrier around the articles.

One prior art device for inserting the tab through the opeining is shown in FIG. 3. Referring to FIG. 3, fingers 301 are spaced apart a predetermined distance and fixedly attached to a rotating shaft 302. The predetermined distance is based on the speed of the carrier 303 as it is transported on a conveying means 304 and the distance between the tabs to be locked. More specifically, carrier 303 is wrapped about articles 305 and transported past rotating shaft 302. As carrier 303 passes by rotating shaft 302 the speed of shaft 302 is such that fingers 301 are brought to the point generally designated at 306 in phantom at the top of rotating shaft 302. As such, fingers 301 extend above the plane of the conveying apparatus 304 and thus contact the tabs of the locking apparatus thereby pushing them through the opening.

The prior art device suffers from a disadvantage in that there is a relatively long period of contact between fingers 301 and the carrier. That is, fingers 301 begin to extend above the plane of the conveying apparatus 304 at point 307 reaching their maximum penetration through the plane of conveying apparatus 304 at point 306. Thereafter the fingers drop back through the plane of the conveying apparatus 304 at point 308. Thus, it takes rotation of approximately 35° or more of the shaft 302 for fingers 301 to go from point 307 to point 308. Thus, fingers 301 are in contact with carrier 303 during the entire time and for the entire distance it takes for carrier 303 to move from point 307 to point 308. The result is that fingers 301 contact carrier 303 both before and after the tab is forced through the opening. The result is as shown in FIG. 4. That is, referring to FIG. 4, slight tearing of the paperboard at points 401 and 401 may occur as tab 403 is forced through opening 404. This tearing occurs because of the contact of fingers 301 both prior to, and after, reaching point 306 where the tab is forced through the opening. This contact by finger 301 on the carrier causes tearing on either side of opening 404 as the finger contacts the surface of the paperboard. This tearing results in a weakened lock and a weakened carrier.

SUMMARY OF THE INVENTION

The invention is a method and apparatus for forcing a larger tab through a smaller opening in an article carrier. A finger is moved into contact with the tab thereby forcing it through the opening. The finger is movably mounted in a bracket such that it may quickly be moved into an extended position and then retracted so as to minimize the time of contact with the article carrier.

In a preferred embodiment, the invention includes a finger mechanism which is slidably mounted on a shaft. A cam is fixedly attached adjacent the rotating shaft. Cam followers, attached to the slidably mounted finger, allow the finger to be directed toward the tab on the carrier lock as the cam followers pass over the lobe of the cam. In an alternate embodiment, the bracket containing the slidably mounted finger is fixedly mounted while the cam containing one or more lobes is rotatably mounted on the shaft. As each lobe passes the finger, the cam follower passes over the lobe and urges the finger toward the tab. In still another embodiment, the finger is electromagnetically activated as the tab passes thereover.

DESCRIPTION OF THE PREFRRED EMBODIMENT

Figure 1:
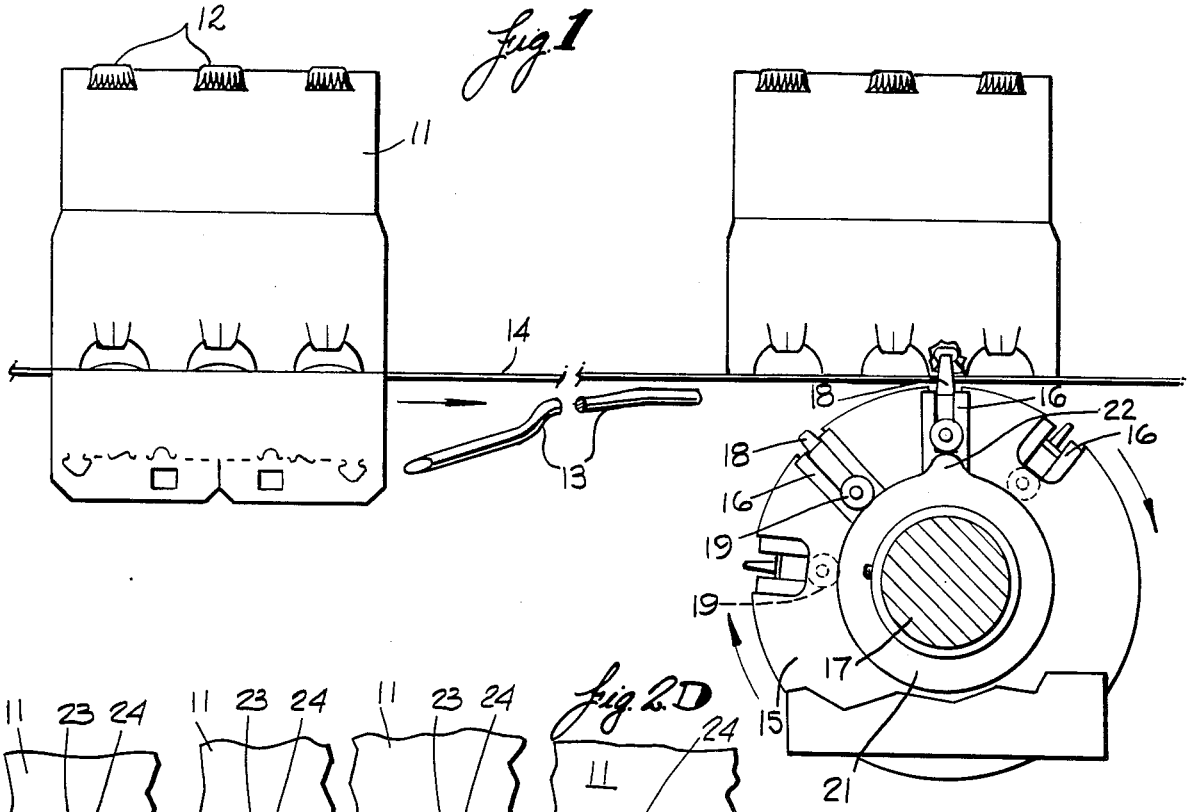
FIG. 1 is a side perspective view of article carriers passing over the cam activated fingers.

Referring to FIG. 1, a carrier 11 is folded about articles 12 by conventional folding apparatus 13. This occurs as articles 12 are transported along a predetermined path by a conveying means which may be a conveyor 14. Conveyor 14 moves articles 12 and carrier 11 to a position over an apparatus for locking carrier 11 around the articles. The apparatus includes a rotating frame 15 upon which are attached a plurality of brackets 16. Frame 15 rotates clockwise in FIG. 1 on a shaft 17. A finger 18 is slidably mounted in each of brackets 16. Connected to the fingers 18 are cam followers 19. Cam followers 19 are rotatably attached to fingers 18 such that followers 19 roll on the surface of a stationary cam 21. Cam 21 includes a lobe portion 22 such that as cam followers 19 rotate around cam 21 and over lobe 22, fingers 18 are urged upwardly into contact with carrier 11.

Figures 2A, 2B, 2C, 2D:
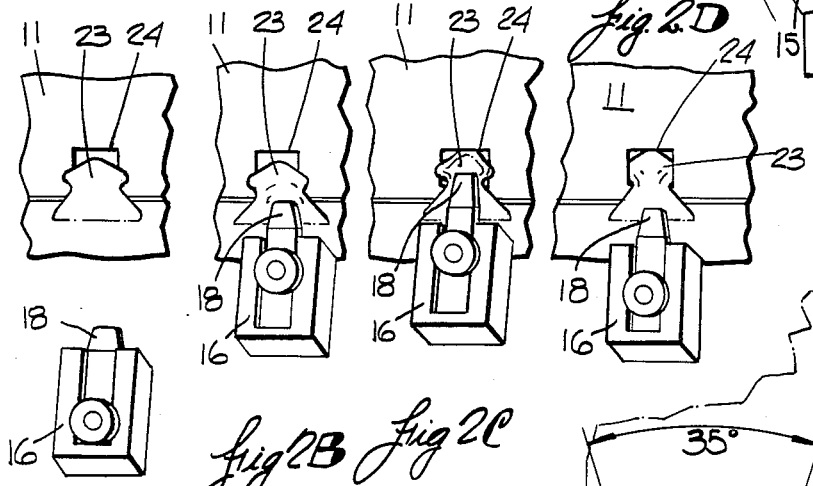
FIGS. 2A–2D are views showing the sequence of activation of the fingers which force the tab through the opening.

Referring to FIG. 2, a portion of the locking mechanism as described in the U.S. Pat. No. 4,437,606 referred to above, and incorporated herein by reference, is shown. Tab 23 is larger in at least one dimension than opening 24. Specifically, in FIG. 2, the width of tab 23 is greater than the width of opening 24 such that tab 23 must be forced through opening 24. This is accomplished, as described above, by deforming tab 23 by contacting it with finger 18 and pushing it through opening 24. FIG. 2C best illustrates this step. Thus, tab 23 must be a flexible material such as paperboard which may be deformed and then return to its orignal shape.

As more clearly shown in FIG. 2, the upward urging of finger 18 by the cooperative action of lobe 22 and cam follower 19 results in the insertlion of tab 23 into and through an opening 24. FIG. 2 indicates a sequence for the insertion of tab 23 through opening 24. That is, FIG. 2A shows tab 23 outside of opening 24 prior to the activation of finger 18 in bracket 16. For purposes of clarity, the rest of the apparatus shown in FIG. 1 is omitted. FIG. 2B shows finger 18 being urged upwardly into contact with tab 23. FIG. 2C shows tab 23 being deformed and forced through opening 24 by the continued upward movement of finger 18. Referring to FIG. 2D, finger 18 has been retracted after tab 23 has been forced through opening 24. Thus, the locking mechanism on carrier 11 is engaged and the carrieris locked about articles 12.

Figure 3:
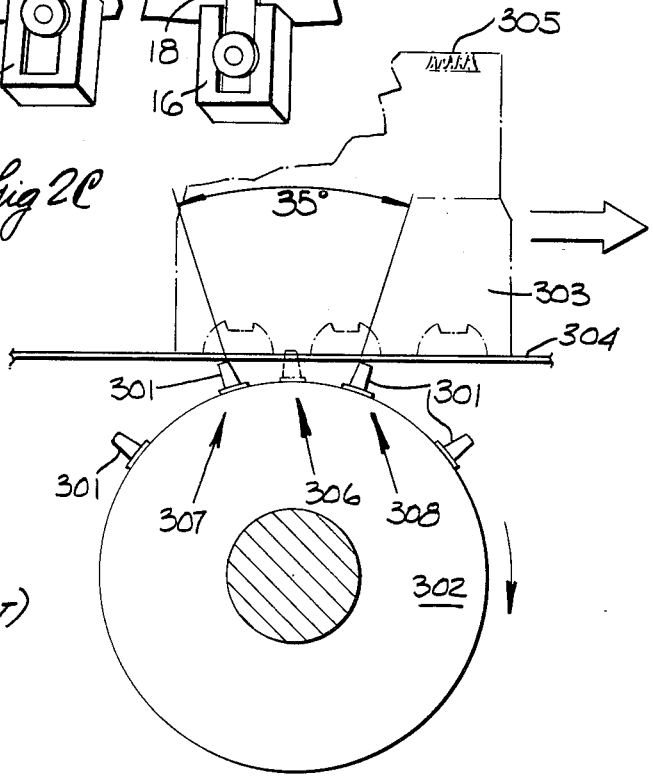
fig. 3 (PRIOR ART)
FIG. 3 is a side view of a prior art device for inserting the tabs through the openings.
Figure 5:
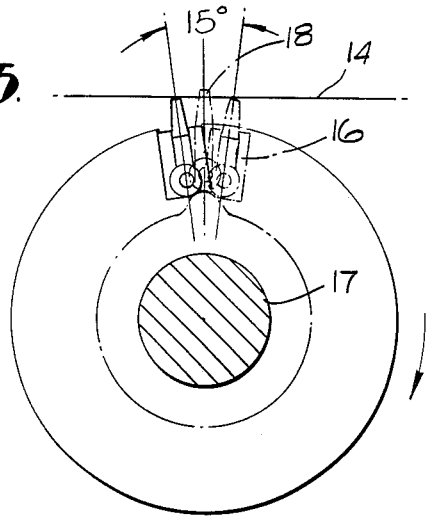
FIG. 5 is a side view of the invention illustrating the sequence of finger movement.
Figure 4:
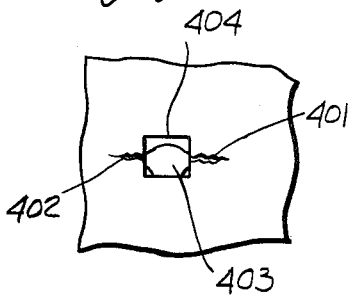
FIG. 4 is a view of a carrier illustrating the drawbacks of the prior art device used in FIG. 3.

Referring to FIGS. 3, 4, and 5, the advantages of the disclosed invention may be appreciated. Specifically, as discussed previously with respect to FIG. 3, the prior art tab locking finger 301 extends above the plane of the bottom of the carrier for an angle of at least 35° resulting in some tearing of the carrier 11 as shown in FIG. 4. That is, because the finger contacted the carrier on either side of opening 24 prior to contacting tab 23 there was a certain amount of abrasion by finger 301 on carrier 11 resulting in tearing of the carrier on either side of opening 24. Referring to FIG. 5, in the present invention, because finger 18 is urged upward by the camming action of the invention, finger 18 is extended above the plane of the bottom of carrier 11 only for an angle of approximately 15° before it again drops below this plane. Thus, the distance of contact of finger 18 with carrier 11 is reduced and there is less likelihood of finger contact and resultant tearing on either side of opening 24 as finger 18 is urged upwardly and retracted. Weakening of the locking mechanism and the carrier is thus prevented.

Figure 6:
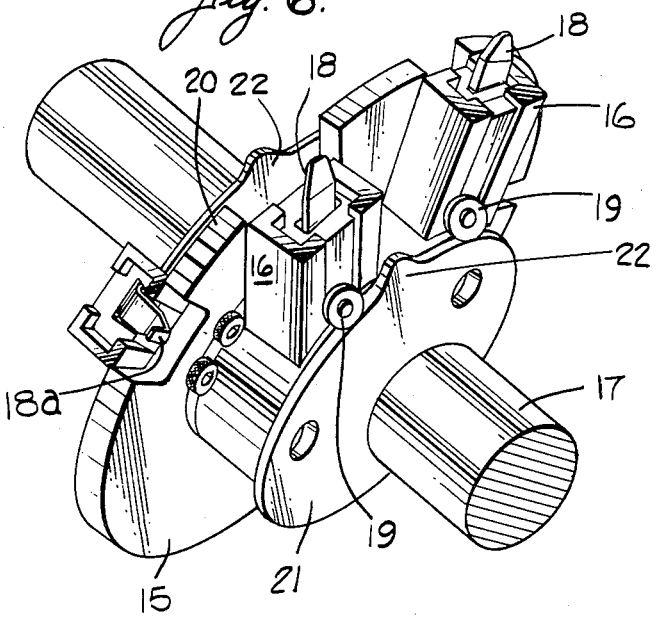
FIG. 6 is a perspective view of the preferred embodiment of the invention illustrating the cam activated fingers.

Referring to FIG. 6, a perspective view of the preferred embodiment of the invention is shown. Specifically, plate 15 is rotatably mounted on shaft 17. Brackets 16 are attached to plate 15. Fingers 18 are slidably mounted in bracket 16 and cam followers 19 are rotatably attached to finger 18. Cam 21 on either side of plate 15 are attached to a frame (not shown) such that the rotation of plate 15 with shaft 17 results in the cam followers 19 rotating on the circumference of cams 21. The rotation of cam followers 19 over lobes 22 on cams 21 causes the fingers 18 to be urged upwardly and into contact with the carrier as previously described. As shown in FIG. 6, various sizes and configurations of the fingers 18 may be employed. That is, the locking mechanism in U.S. Pat No. 4,437,606 incorporated herein by reference, requires that four locking mechanisms be engaged on the carrier. The two outboard locks at either end are smaller than the two inboard locks. Thus, a total of four tab insertions must be accomplished for each carrier. To accomplish this, four fingers are attached to plate 15. Only three are shown in FIG. 6. However, a fourth would be located on the backside of plate 15 and not visible in this view. The hidden finger and the finger identified as 18(*a*) in FIG. 6 are smaller in width than fingers 18 disclosed previouslly and shown in FIG. 6 as fingers 18. Thus, the first and last finger, being smaller, would be used to force the smaller tabs at the ends of the carrier through the corresponding openings. The larger fingers 18 would be utilized to force the larger tabs identified as 23 herein through openings 24. While this configuration is utilized in the preferred embodiment, it should be expressly understood that if more or less locking tabs were used or if different sized locking tabs were used the number and size of the fingers 18 or 18(*a*) could be altered. In addition, as shown in FIG. 6, fingers 18 are shown on one side of plate 15 while the brackets 16 holding fingers 18(*a*) are shown attached to the opposite side of plate 15 with a cam follower (not shown) attached to finger 18(*a*) riding on a second cam 20 on that opposite side of plate 15. It may be possible to have all four brackets 16 and fingers 18 and/or 18(*a*) on the same side of plate 15 and all riding on one cam. In addiion, it may be appreciated that the distance between adjacent brackets 16 on plate 15 depends upon machine speeds and other engineering design considerations.

Figure 7:
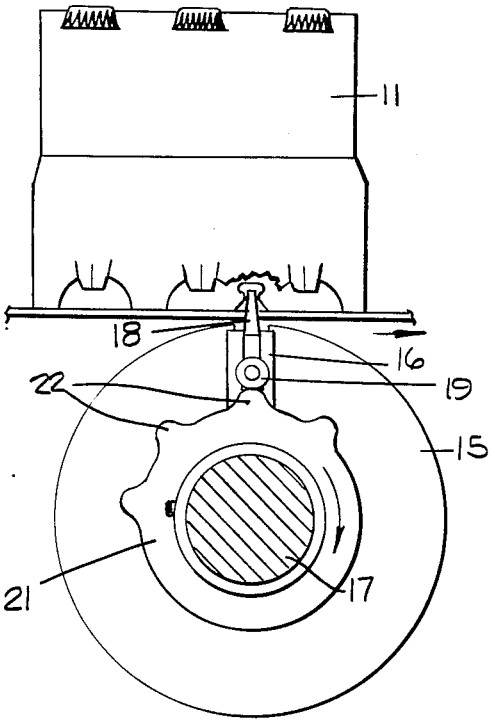
FIG. 7 is a side view of an alternate embodiment of the invention illustrating a rotating cam and a stationary finger bracket.
Figure 8:
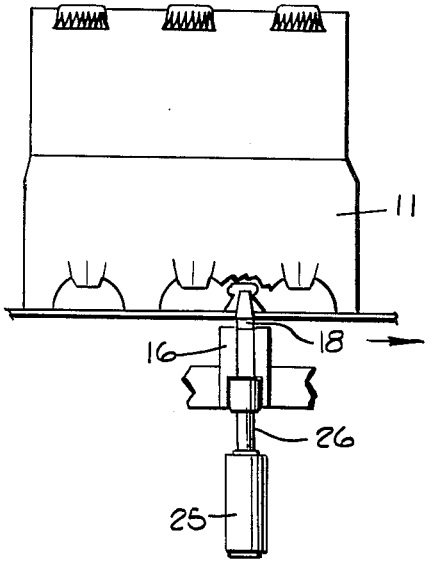
FIG. 8 is a side view of an alternate embodiment of the invention illustrating an electromagnetically activated finger.

Two alternate embodiments of the invention are shown in FIGS. 7 and 8. Referring to FIG. 7, bracket 16 is fixedly attached to a stationary frame 15 while cam 21 rotates on shaft 17. Thus, cam 21 includes multiple lobes 22 which cooperate with cam follower 19 to urge finger 18 upwardly into contact with carrier 11 each time a lobe 22 passes cam follower 19. In this way only one finger 18 may be required to perform multiple insertions of tabs into openings. In the preferred embodiment, as disclosed above, the cam is fixed and the brackets and fingers are rotated.

In the embodiment shown in FIG. 8, the urging means includes a solenoid which is connected to finger 18 by plunger 26 or other suitable device. In fact, solenoid 25 need not be connected to finger 18 but rather just have plunger 26 contact finger 18 to urge it upwardly into contact with carrier 11. This electromagnetic urging means eliminates the need for rotating shaft 17 or other moving mechanical parts. The use of this electromagnetic activated urging means allows finger 18 to be extended into contact with tab 23 and retracted precisely while reducing the number of moving parts.

While the invention has been disclosed with respect to a preferred embodiment thereof, it is not to be so limited as changes and modifications may be made which are within the full intended scope of the invention as defined by the appended claims. For example, the alternate embodiment shown in FIGS. 7 and 8 or any other suitable urging means may be employed to urge the fingers into contact with the locking means on the carrier. The size and number of fingers employed on the apparatus is also subject to engineering design considerations. Similarly, the spacing of the fingers one from another is dependent upon machinery speed.

What is claimed is:

1. An apparatus for substantially enclosing articles in a carrier comprising:

means, adjacent said articles, for conveying said articles along a predetermined path;

means, positioned along said path, for folding said carrier about said articles;

said carrier including a flexible tab and an opening, said tab having at least one dimension greater than the corresponding dimension of the opening;

a finger movably mounted adjacent said conveying means; and means, including an elecromagnetically activated device operatively associated with said finger, for urging said finger into contact with said tab thereby inserting said tab through said opening.

2. Apparatus according to claim 1 wherein said carrier includes a paperboard blank.

3. Apparatus according to claim 1 wherein said tab has a width exceeding the width of said opening.

4. Apparatus according to claim 1 wherein said finger is slidably mounted in a bracket.

5. Apparatus according to claim 1 wherein said electromagnetically activated device includes a solenoid switch.

6. A method for locking a wrap-around carrier about one or more articles, said carrier including on the bottom wall thereof a locking mechanism having a tab and an opening, said tab having at least one dimension greater than the corresponding dimension of the opening, said method comprising the steps of:

transporting said article along a predetermined path;

surrounding said article with said carrier such that said tab is adjacent said opening and both said tab and said opening are adjacent the bottom of the article;

directing a finger adapted for reciprocal motion into contact with said tab;

moving the finger upwardly against said tab and deforming said tab;

moving the finger further upwardly and forcing said tab through said opening; and retracting said finger from contact with said tab.

7. A method for locking a wrap-around carrier according to claim 6, wherein the finger is carried on a rotatably mounted support located beneath the predetermined path and is reciprocally actuated by stationary cam means.

8. A method for locking a wrap-around carrier according to claim 6, wherein the finger is mounted beneath the predetermined path and is reciprocally actuated by rotary cam means.

9. A method for locking a wrap-around carrier according to claim 6, wherein the finger is mounted beneath the predetermined path and is reciprocally activated by electromagnetic means.

* * * * *